United States Patent [19]

Lamar

[11] Patent Number: 4,866,801

[45] Date of Patent: Sep. 19, 1989

[54] SPRINKLER RISER EXTRACTOR TOOL

[76] Inventor: John W. Lamar, 565 Riverside Rd., Oak View, Calif. 93022

[21] Appl. No.: 270,780

[22] Filed: Nov. 14, 1988

[51] Int. Cl.[4] ..... B25F 1/00

[52] U.S. Cl. ..... 7/165; 29/253

[58] Field of Search ..... 7/165, 170; 81/444, 81/488, 451, 453, 455; 269/48.1; 29/253, 255, 280

[56] References Cited

U.S. PATENT DOCUMENTS

| | | | |
|---|---|---|---|
| 2,497,633 | 2/1950 | Shapiro et al. | 29/280 |
| 3,825,048 | 7/1974 | Triska | 81/444 |
| 4,229,999 | 10/1980 | Rottigni | 7/165 |
| 4,577,899 | 3/1986 | Hemingway | 29/280 |
| 4,696,102 | 9/1987 | Overbay | 81/444 |
| 4,746,158 | 5/1988 | Fields | 29/280 |
| 4,779,494 | 10/1988 | Quach | 81/444 |

*Primary Examiner*—Roscoe V. Parker

[57] ABSTRACT

A sprinkler riser extractor tool in the form of a screw driver having a head sized to fit the slot of the flow control screw in the nozzle of a sprinkler head and having a sleeve slidably mounted on the shaft of said screw driver formed with a flange adjacent the proximal end of said sleeve to facilitate actuation by the thumb of the operator and having a bushing adjacent the distal end of said sleeve for expanding said distal end when said sleeve is slid forwardly to engage the inside of a sprinkler riser for facilitating lifting of said riser.

9 Claims, 2 Drawing Sheets

FIG. 2
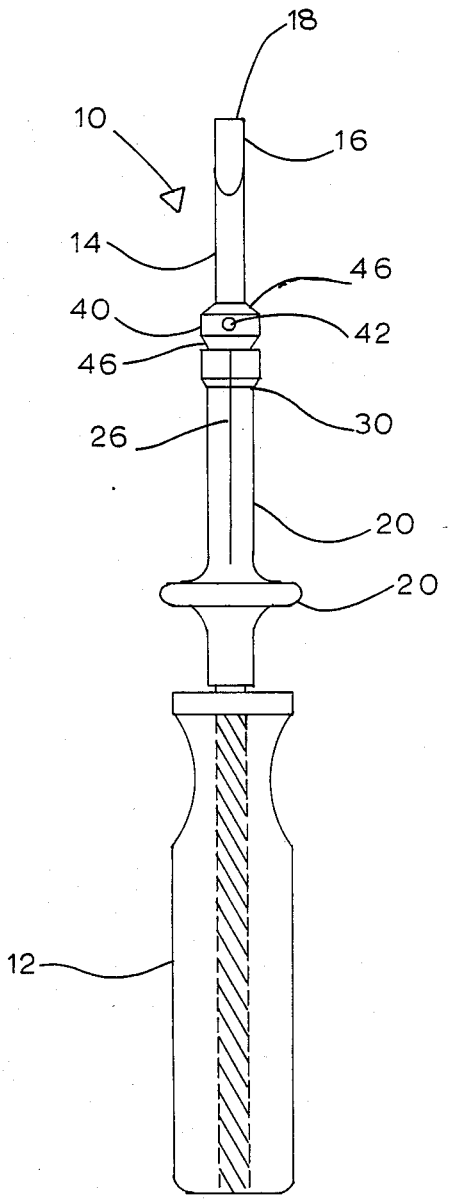
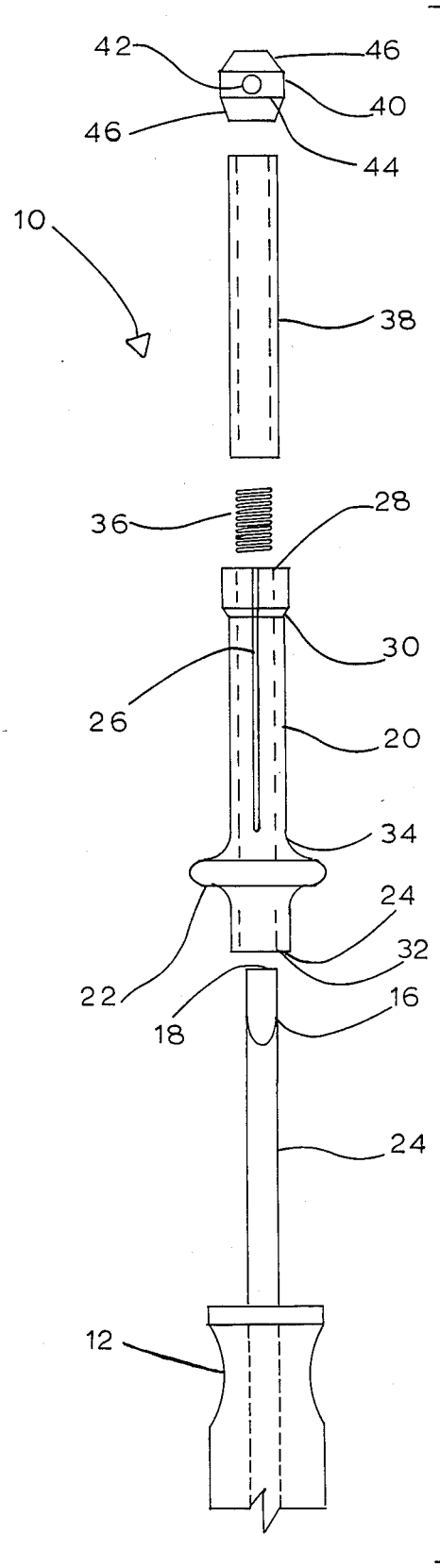
FIG. 1

SPRINKLER RISER EXTRACTOR TOOL

BACKGROUND

1. Field Of Invention

This invention relates to hand tools and is particularly directed to a hand tool for extracting the riser of pop-up type water sprinklers and the like.

2. Prior Art

Wherever there are lawns or gardens, there is a necessity for frequent watering. To accomplish such watering by having someone stand and sprinkle the area with a hose is extremely time consuming and, with today's labor costs, is prohibitively expensive. To overcome these problems, it has been common to provide a plurality of sprinkler heads placed at desired locations about the area and connected by buried pipes to a common source of water. Originally, these sprinkler heads were mounted several inches above the surface of the ground on vertical pipes which extended upward from the buried supply pipes. However, these above-ground sprinkler heads were often unsightly and presented a hazard to persons, especially children, walking or running in the vicinity.

More recently, it has become the practice to provide sprinkler heads which are mounted on risers that lie below the surface of the ground, when the sprinkler is not in use, and which, when the water is turned "On", are forced upward to their operative positions by hydraulic pressure. These pop-up sprinklers overcome most of the disadvantages of the earlier above-ground sprinklers. However, the pop-up sprinklers present unique problems when they require servicing. The risers of the pop-up sprinklers are mounted in housings which are buried below the surface of the ground and are normally urged, by a strong spring, to a retracted position within the housing. When the sprinkler system is turned "On", the water pressure forces the risers upward, against the action of the spring, to their operative position and some of the water passes through the sprinkler head to be distributed to the lawn or garden area. Since servicing of the sprinkler heads must be performed when the sprinklers are not in operation, the pop-up type sprinkler heads will be in their retracted positions and some means must be provided to force the risers upward, against the action of their springs, in order to gain access to the heads. Furthermore, since a considerable amount of water is often present in the vicinity of the riser and sprinkler head during servicing, tools used is such servicing are often damaged or destroyed by rust. Also, prior to the nozzle being applied to the head, during installation, dirt and other obstruction can impair the ability of the spring-retracted riser from receiving the required nozzle until the riser has been cleaned, which usually involves lifting the riser while water flows through the head. This is often a difficult and time-consuming task.

In the past, no tool has been provided specifically for this purpose and it has been necessary for service personnel to improvise their own methods and apparatus for lifting the risers and servicing the sprinkler heads. Unfortunately, these improvised methods are often unsuccessful, difficult to perform and may result in damage to the sprinkler head or riser. A search in the U.S. patent Office has revealed the following references:

| U.S. Pat. No. | INVENTOR | ISSUED |
|---|---|---|
| 2,497,633 | J. Shapiro et al | Feb. 14, 1950 |
| 2,694,603 | F. R. Griffin | Nov. 16, 1954 |
| 2,847,752 | J. T. Simmons | Aug. 19, 1958 |
| 2,947,074 | C. M. Newman | Aug. 2, 1960 |
| 3,138,855 | C. D. Marshall | June 30, 1964 |
| 3,210,832 | G. H. Kalen | Oct. 12, 1965 |
| 3,588,983 | R. C. Hoy | June 29, 1971 |
| 3,654,686 | F. R. McFarland et al | Apr. 11, 1972 |
| 4.050,148 | J. K. Hastings | Sep. 27, 1977 |
| 4,052,788 | J. K. Hastings et al | Oct. 11, 1977 |
| 4,096,617 | A. J. Ritter, Jr. | June 27, 1978 |
| 4,184,245 | W. R. Mattingly, Jr. | Jan. 22, 1980 |
| 4,498,233 | C. C. Simms | Feb. 12, 1985 |
| 4,577,899 | J. K. Hemmingway | Mar. 25, 1986 |
| 4,583,275 | E. M. Diaz | Apr. 22, 1986 |
| 4,746,158 | K. L. Fields | May 24, 1988 |

Each of these references relates to a tool for extracting or removing some object. However, none of the reference patents is concerned with the unique problems involved in lifting sprinkler risers and servicing sprinkler heads. Thus, none of the prior art tools have been entirely satisfactory.

BRIEF SUMMARY AND OBJECTS OF INVENTION

These disadvantages of prior art tools are overcome with the present invention and a sprinkler riser extractor tool is provided which permits rapid and easy lifting of sprinkler risers and performs virtually all operations required for servicing sprinkler heads and risers, yet is resistant to water damage.

The advantages of the present invention are preferably attained by providing a sprinkler riser extractor tool in the form of a screw driver having a head sized to fit the slot of the flow control screw in the nozzle of the sprinkler head and having a sleeve slidably mounted on the shaft of said screw driver formed with a flange adjacent the proximal end of said sleeve to facilitate actuation by the thumb of the operator and having means adjacent the distal end of said sleeve for expanding said distal end when said sleeve is slid forwardly to engage the inside of a sprinkler riser for facilitating lifting of said riser.

Accordingly, it is an object of the present invention to provide a hand tool for extracting sprinkler risers and servicing the sprinkler heads.

A further object of the present invention is to provide a hand tool for lifting sprinkler risers during nozzle installation to facilitate cleaning away dirt and other obstructions which could impair riser movement.

Another object of the present invention is to provide a hand tool for facilitating the lifting of sprinkler risers and the like.

An additional object of the present invention is to provide a hand tool for extracting sprinkler risers and servicing the sprinkler heads which will resist damage and corrosion due to water.

A specific object of the present invention is to provide a sprinkler riser extractor tool in the form of a screw driver having a head sized to fit the slot of the flow control screw in the sprinkler head and having a sleeve slidably mounted on the shaft of said screw driver formed with a flange adjacent the proximal end of said sleeve to facilitate actuation by the thumb of the operator and having means adjacent the distal end of said sleeve for expanding said distal end when said sleeve is slid forwardly to engage the inside of a sprinkler riser for facilitating lifting of said riser.

These and other objects and features of the present invention will be apparent from the following detailed description, wherein reference is made to the figures of the accompanying drawings.

BRIEF DESCRIPTION OF THE DRAWINGS

FIG. 1 is an exploded view of a sprinkler riser extractor tool embodying the present invention;

FIG. 2 is a side view of the tool of FIG. 1 showing the sleeve in its retracted position;

DETAILED DESCRIPTION OF THE INVENTION

Figure 4:
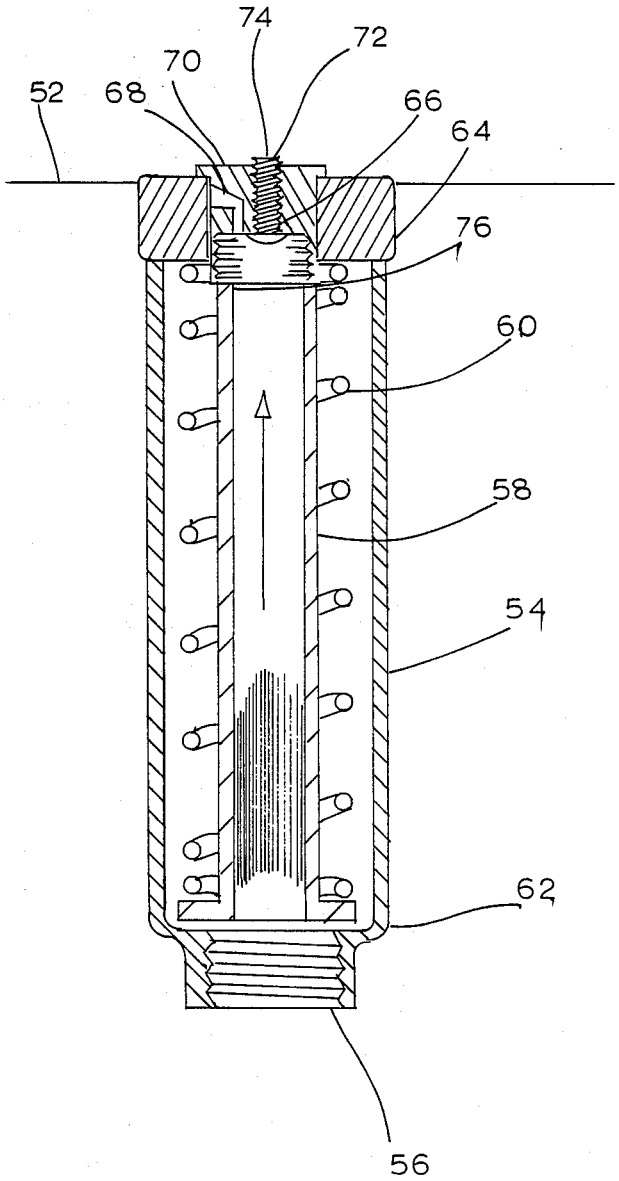
FIG. 4 is a vertical section through a pop-up sprinkler, shown in its normal buried position.

In that form of the present invention chosen for purposes of illustration, FIG. 1 shows a sprinkler riser extractor tool, indicated generally at 10, comprising a screw-driver-like hand tool having a handle 12 with a shaft 14 projecting axially from one end of the handle 12. The handle 12 may be formed of wood, plastic, rubber or other suitable material and is sized be comfortably gripped by a user's hand, preferably having a diameter of approximately 1⅛ inches and a length of approximately 1½ to 4 inches. The shaft 14 is formed of water-resistant material, such as stainless steel and has a diameter of approximately 3/16ths of an inch with the distal end 16 of the shaft 14 being beveled to form a tip 18 having a thickness of approximately 0.034 inch, so as to mate conveniently with the adjustment slot of the flow control screw of a sprinkler head, as seen in FIG. 4. Preferably the length of the shaft 14 is approximately 6 inches and a sleeve 20 is slidably mounted on the shaft 14. The sleeve 20 is preferably approximately 3.5 to 4 inches in length and a flange 22 projects outwardly adjacent the proximal end 24 of the sleeve 20 to facilitate actuation of the sleeve 20 by the user's thumb. The sleeve 20 is formed with a plurality of slits 26 extending longitudinally of the sleeve 20 approximately 2 inches from the distal end 28 thereof and the distal end 28 is formed with a lip portion 30 having a slightly greater diameter than that of the sleeve 20. The proximal end 24 of the sleeve 20 is formed with an axial bore 32 having a diameter slightly greater than that to the shaft 14 so as to permit the sleeve 20 to slide freely along the shaft 14, while the portion of the sleeve 20 adjacent the slits 26 has a bore 34 of slightly greater diameter than that of bore 32. Within the bore 34, a spring 36 and tubular spacer 38 are slidably mounted on the shaft 14 and a bushing 40 is secured to the shaft 14 by suitable means, such as a set screw 42, to retain the spacer 38, spring 36 and sleeve 20 in a desired position on the shaft 14. The bushing 40 has a central bore 44 sized to slidable receive the shaft 14 and is formed with beveled upper and lower surfaces 46.

Figure 3:
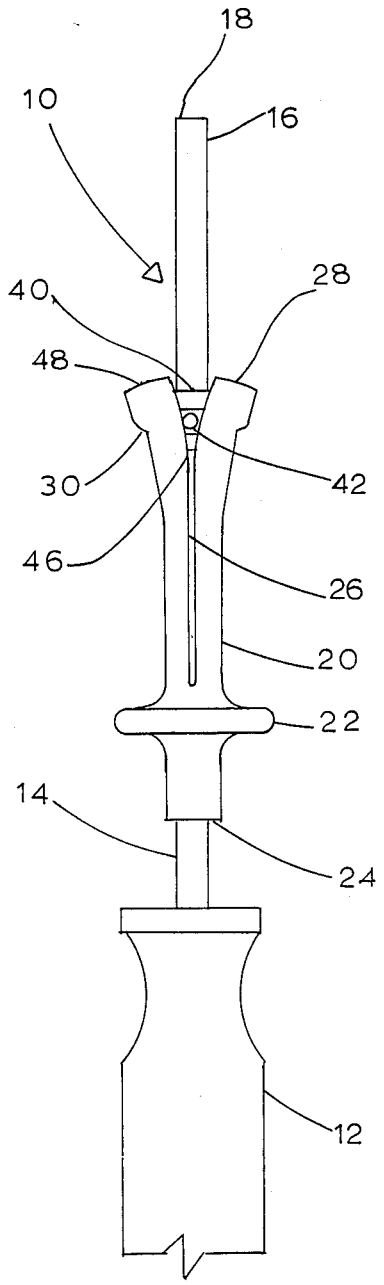
FIG. 3 is a view, similar to that of FIG. 2, showing the tool of FIG. 1 with the sleeve in its extended position.

In use, the sleeve 20, spring 36 and spacer 38 are slid onto the shaft 14 of the tool 10 and the bushing 40 is fixedly secured, by set screw 42, in a desired position along the shaft 14. Normally, spring 36 will bear against spacer 38 and bushing 40 to urge the sleeve 20 to its retracted position with the proximal end 24 of the sleeve 20 in proximity to the handle 12. However, if the user presses his thumb against the flange 22, the sleeve 20 will be forced forwardly against the action of the spring 36 causing the portions 48 of the distal end 28 of the sleeve 20 between the slits 26 to bear against the bevelled surface 46 of the bushing 40 and to splay outwardly, as seen in FIG. 3.

FIG. 4 is a vertical section through a typical pop-up sprinkler, indicated generally at 50, shown in its normal position buried in the ground 52. As shown, the sprinkler 50 comprises a generally cylindrical housing 54 having a threaded fitting 56 at the lower end thereof for joining to the underground water supply system, not shown. Within the housing 54, a riser 58 is slidably mounted and is normally urged into a retracted position by spring 60. The riser 58 has a flanged lower end 62 which the spring 60 bears against and which, when the water is turned "On", serves as a piston to drive the riser 58 upwardly so that flange 62 of the riser 58 bears against the top portion 64 of the housing 54. After this, the water passes through passages 66 and 68 in the sprinkler head 70, which is mounted on the upper end of the riser 58, to spray the desired area. The flow of water through passages 66 and 68 of the sprinkler head 70 is regulated by flow control screw 72, which is adjusted by means of a screw slot 74. To service the sprinkler 50, the sprinkler head 70 must be removed to assure that the passages 66 and 68 are free from sand, dirt or other obstructions. At this time, the position of the flow control screw 72 can be adjusted, as desired, by inserting the tip 18 of the shaft 14 of tool 10 into the slot 74 of the flow control screw 72 and rotating the tool 10 to drive the flow control screw 72 into or out of the sprinkler head 70. While this is being done, the spring 60 forces the riser 58 to its normal retracted position within the housing 54 of the sprinkler 50. However, when the head 70 is ready for reassembly to the riser 58, it is necessary to lift the riser 58 from its retracted position. Without a proper tool, this is an extremely difficult operation. However, with the sprinkler riser extractor tool 10 of the present invention, this operation can be performed quickly and easily by inserting the distal end 18 of the tool 10 into the interior of the riser 58 and pressing the user's thumb against flange 22 of sleeve 20. As noted above, this causes the portions 48 of the sleeve 20 to bear against the bevelled surfaces 46 of the bushing 40 and to splay outwardly. When the tool 10 is inserted in the riser 58, this splaying action causes the portions 48 of the sleeve 20 to bear forcibly against the interior of the riser 58 and, when the tool 10 is withdrawn, causes the riser 58 to be lifted to its extended position where the user can easily grasp the riser 58 to prevent the spring 60 from returning the riser 58 to its retracted position within the sprinkler housing 54. Frequently, the riser 58 will be formed with an internal lip, as seen at 76. If so, the lip portion 30 of the sleeve 20 can engage the lip 76 of the riser 58 to facilitate lifting of the riser 58.

As shown, bushing 40 is provided with bevelled surfaces 46 on both its upper and lower edges. While this permits the bushing 40 to be mounted on the shaft 14 with either edge upward, it will be apparent that the bevel on the lower edge could, if desired, be omitted. Furthermore, it will be apparent that at least two of the slits 26 must be provided in the sleeve 20. Three such slits are preferred, however, the number of slits 26 can be increased, substantially as desired. In addition, numerous other variations and modifications can, obviously, be made without departing from the spirit of the present invention. Therefore, it should clearly be understood that the forms of the present invention described above and shown in the figures of the accompanying drawings are illustrative only and are not intended to limit the scope of the present invention.

What is claimed is:

1. A sprinkler riser extractor tool comprising:

a first member in the form of a screw driver having a handle and a shaft projecting axially from one end of said handle, a sleeve slidably mounted on said shaft having a radially outward projecting flange adjacent the proximal end of said sleeve and having a plurality of slits beginning at the distal end of said sleeve and extending longitudinally of said sleeve, and a bushing fixedly secured to encircling said shaft and having a bevelled led surface engagable by said distal end of said sleeve, 2. The tool of claim 1 further comprising:

resilient means normally urging said sleeve into proximity with said one end of said handle.

3. The tool of claim 1 wherein:

said shaft has a diameter of 3/16th inch.

4. The tool of claim 1 wherein:

said handle, shaft, sleeve and bushing are formed of water-resistant material.

5. The tool of claim 1 wherein:

said shaft is formed of stainless steel.

6. The tool of claim 1 further comprising:

said sleeve having an axial bore with a portion adjacent the proximal end of said sleeve dimensioned to slide freely on said shaft and an enlarged portion adjacent said slits of slightly greater diameter, a spacer member of generally tubular configuration slidably mounted on said shaft and located within said enlarged portion, and a spring slidably mounted on said shaft and interposed between said spacer member and said sleeve within the bore of said sleeve.

7. The tool of claim 1 wherein:

said bushing is formed with upper and lower bevelled edges.

8. The tool of claim 1 wherein:

said slits extend approximately two-thirds the length of said sleeve.

9. The tool of claim 1 wherein:

the portions of said sleeve adjacent said slits splay outward when said sleeve is urged against said bushing to permit gripping engagement with the interior of a sprinkler riser to facilitate lifting said riser.

* * * * *